US006561291B2

(12) United States Patent
Xiang

(10) Patent No.: US 6,561,291 B2
(45) Date of Patent: May 13, 2003

(54) ROLLER CONE DRILL BIT STRUCTURE HAVING IMPROVED JOURNAL ANGLE AND JOURNAL OFFSET

(75) Inventor: Ying Xiang, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 26 days.

(21) Appl. No.: 09/749,204

(22) Filed: Dec. 27, 2000

(65) Prior Publication Data

US 2002/0079138 A1 Jun. 27, 2002

(51) Int. Cl.[7] ..... E21B 10/00
(52) U.S. Cl. ..... 175/341; 175/420.1; 175/413
(58) Field of Search ..... 175/331, 341, 175/412, 413, 420.1

(56) References Cited

U.S. PATENT DOCUMENTS 5,606,895 A * 3/1997 Huffstutler
5,624,002 A * 4/1997 Huffstutler
5,833,020 A 11/1998 Portwood et al. ..... 175/331

FOREIGN PATENT DOCUMENTS

GB 2343905 A 5/2000 ..... E21B/10/16

OTHER PUBLICATIONS

Great Britain Combined Search and Examination Report Dated Apr. 16, 2002, 4 pages be application GB 0129627.6.

* cited by examiner

*Primary Examiner*—Roger Schoeppel
(74) *Attorney, Agent, or Firm*—Rosenthal & Osha L.L.P.

(57) ABSTRACT

A roller cone drill bit is shown which includes at least one roller cone rotatably mounted on a journal forming a part of a bit body. The at least one cone having cutting elements disposed at selected locations thereon. The at least one roller cone subtends a journal angle of less than about 35 degrees, and has an offset less than about 0.15 inches. In one embodiment, gage row cutting elements on the at least one roller cone define an oversize angle in a range of about −1.5 to +2 degrees.

6 Claims, 4 Drawing Sheets

ROLLER CONE DRILL BIT STRUCTURE HAVING IMPROVED JOURNAL ANGLE AND JOURNAL OFFSET

FIELD OF THE INVENTION

This invention is related to the field of drill bits used to drill wellbores in the earth. More specifically, the invention is related to structures for roller cone drill bits which have improved drilling performance.

BACKGROUND OF THE INVENTION

Roller cone rock bits and fixed cutter bits are commonly used in the oil and gas industry, as well as in the mining industry, for drilling wellbores through earth formations. FIG. 1 shows one example of a conventional drilling system used to drill such a wellbore. The drilling system includes a drilling rig 10 used to turn a drill string 12 which extends downward into the well bore 14. Connected to the end of the drill string 12 is a roller cone-type drill bit 20, shown in further detail in FIG. 2.

The roller cone bit 20 typically includes a bit body 22 having an externally threaded connection at one end 24 for coupling to the drill string (12 in FIG. 1), and a plurality of roller cones 26 (usually three as shown) attached to the other end of the bit 20 and able to rotate with respect to the bit body 22. Attached to the cones 26 of the bit 20 are a plurality of cutting elements 28 typically arranged in rows about the surface of each of the cones 26. The cutting elements 28 can be tungsten carbide inserts, polycrystalline diamond compacts, or milled steel teeth.

As is known in the art, the drilling system typically includes apparatus for circulating drilling fluid through the drill string (12 in FIG. 1) and the bit 20 to cool the bit and to lift cuttings out of the wellbore (14 in FIG. 1). For wellbores drilled to extract oil and gas, the drilling fluid is typically "mud" or similar liquid. For mining applications, the drilling fluid is often compressed air. The principles of roller cone bit design are similar in either case.

Drill bits are classified and selected for use according to the characteristics of the earth formations that are expected to be drilled with the particular drill bit. A drill bit classification system has been adopted by the International Association of Drilling Contractors (IADC) which includes a 3-digit identification number to characterize drill bits according to the formations expected to be drilled. Formations having increasing hardness are generally drilled by bits having higher numbers in the classification. The first number in the IADC code is called the "series" and is related to the type of cutting element on the roller cones. First numbers in the range 1–3 are "milled tooth" bits, while first numbers in the range 4–8 are "insert" type bits. The first number (the series) increases as the hardness of the formation to be drilled increases. The second number in the classification is related to the bit type within the series. Because the third number of the IADC code relates only to bearing design and gage protection, it is omitted herein, as extraneous. Harder formations are typically drilled with bits having a higher second number classification. For example, a drill bit in IADC class 5–3 is used to drill harder formations than a bit in IADC class 5–2.

Generally, roller cone drill bits known in the art having IADC classification of 6-1 and higher have particular structural characteristics (design parameters) believed to be advantageous when drilling the formations for which these bits are intended. One such design parameter is the "journal angle", which is defined as an angle subtended between the axis of rotation of the roller cones and a plane perpendicular to the axis of rotation of the drill bit. Prior art bits of IADC class 6-1 and higher typically have a journal angle of about 36 degrees or more. Softer formation bits (typically in IADC classes lower than 6-1) have journal angles of about 32 to 33 degrees.

Another design parameter of roller cone drill bits is called "offset", which is defined as the separation between the rotational axis of each roller cone and a line perpendicular to the axis of rotation of the bit which intersects the axis of rotation of the bit (meaning a line extending radially outward from the axis of rotation of the bit). Typical prior art drill bits used to drill harder formations (IADC class 6-1 and higher) have offset of about 0.125 inches (3.2 mm). Softer formation bits have offset of at least about 0.219 inches (5.6 mm).

Another design parameter is known as "oversize angle", which is defined as the angle subtended between a line perpendicular to the axis of rotation of the bit, and a line connecting two specific points. The first specific point is the intersection of the rotation axis of one of the roller cones and a plane perpendicular to the axis of rotation of the bit. The second specific point is the point of contact between the cutting elements in an outermost row of cutting elements, called the "gage row", and a curve known as the "gage curve". Calculation of the gage curve is known in the art, and is described, or example in U.S. Pat. No. 5,833,020 issued to Portwood et al. Typical prior art hard formation bits (IADC class 6-1 and higher) have oversize angles in a range of about 1 to 1.5 degrees. Soft formation bits have oversize angles typically greater than about 2 degrees.

Prior art roller cone drill bits are generally designed by testing a selected design under actual drilling conditions. The drilling performance and wear characteristics of the selected bit design are compared with those of bits having other designs. Because of the large number of design parameters in the typical roller cone drill bit, it has been impractical, using prior art design techniques, to test all of the design parameters on a drill bit. As a result, typical prior art roller cone bits have journal angles, offset and oversize angles which are carried forward from previous bit designs. Journal angles, offset and oversize angles of prior art bits may not always provide optimal drilling performance. It is desirable to have a drill bit in which journal angle, offset and/or oversize angle have been determined to provide better drilling performance.

SUMMARY OF THE INVENTION

One aspect of the invention is a roller cone drill bit which includes at least one roller cone rotatably mounted on a journal forming a part of a bit body. The at least one cone has cutting elements disposed at selected locations thereon. The at least one roller cone has a journal angle of less than about 35 degrees, and an offset less than about 0.15 inches.

In one embodiment, gage row cutting elements on the at least one roller cone define an oversize angle in a range of about −1.5 to +2 degrees.

Other aspects and advantages of the invention will be apparent from the following description and the appended claims.

DETAILED DESCRIPTION OF THE INVENTION

Figure 1:
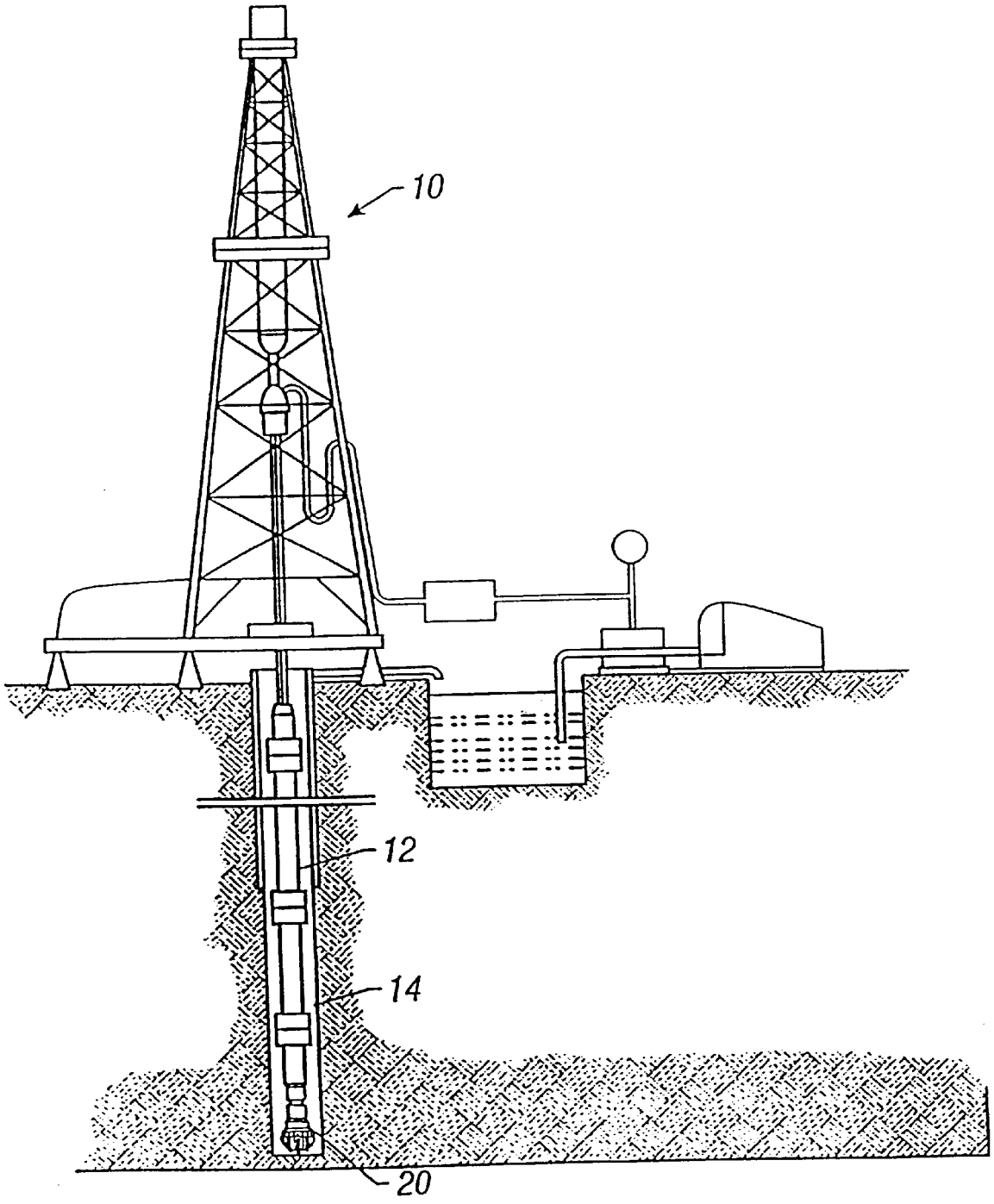
FIG.1 (Prior Art)
FIG. 1 shows a prior art drilling system.
Figure 2:
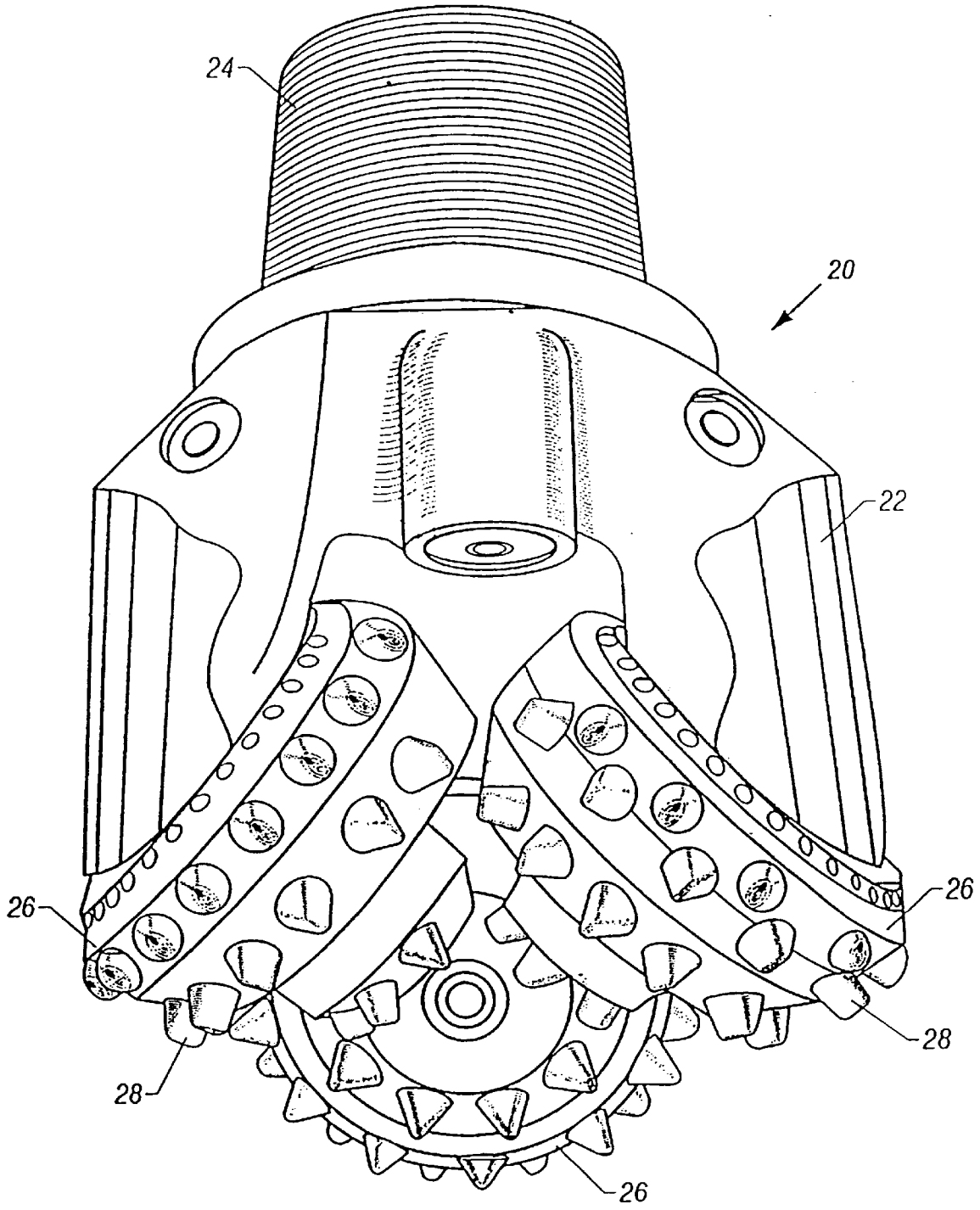
FIG.2 (Prior Art)
FIG. 2 shows a typical prior art roller cone drill bit.
Figure 3:
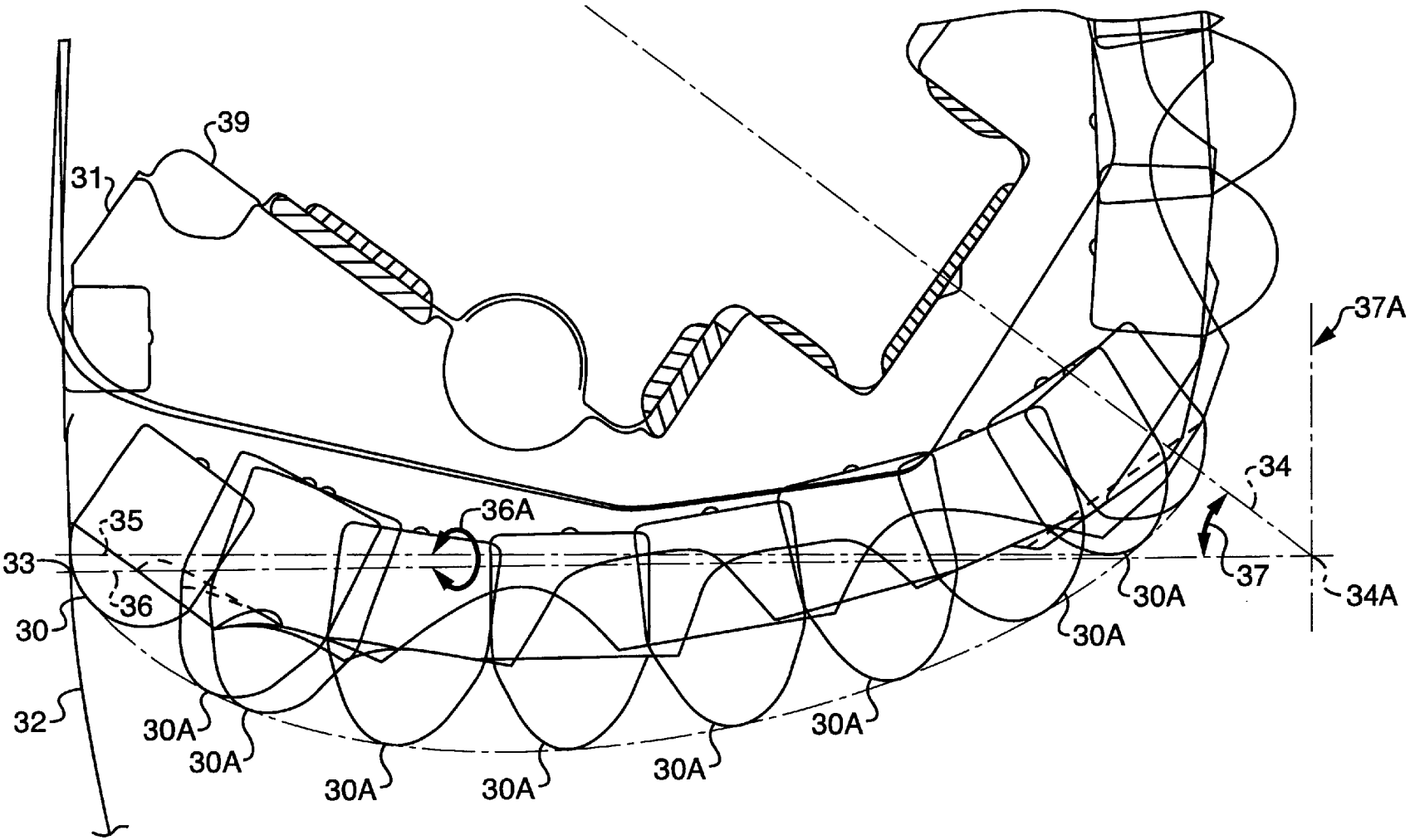
FIG. 3 shows an example of cross sectional view of the roller cones on a 3 cone bit projected into the same plane to show journal angle and oversize angle.

FIG. 3 shows a cross sectional view through the roller cones on a drill bit having three such roller cones, where the cross sections of all the cones are projected into a single plane. Each cone 31 is rotatably mounted on. a journal 39. Bearing systems on which the cones 31 rotate, cone locking systems and bearing seal systems (not shown in FIG. 3) can be of any type known in the art, and are not intended to limit the invention. The cones 31 have cutting elements 30 and 30A mounted on them, typically in rows about the circumference of each cone 31. The rows typically include one row disposed in a lateral position adapted to cut earth formations at full bit diameter. Cutting elements in these rows are known as gage cutting elements 30. For purposes of describing the invention, all the other cutting elements are referred to as "interior row" cutting elements, and are shown generally at 30A. The cutting elements are typically tungsten carbide inserts but they may also be made from other materials such as polycrystalline diamond, boron nitride, or combinations of materials known in the art for making inserts.

Each cone 31 rotates about an axis 34 of the journal 39. An angle 37 subtended between the journal axis 34 and a line 35 substantially perpendicular to and intersecting the rotational axis of the bit 37A is known as the journal angle. In bits made according to the invention, the journal angle 37 is less than about 35 degrees. More preferably, the journal angle 37 is in a range of about 30 to 34 degrees, and most preferably, the journal angle 37 is about 32½ degrees. As explained in the Background section herein, prior art bits used to drill hard earth formations (typically in IADC classes 6-1 and higher) typically have journal angles of about 36 degrees or more.

A point of intersection 34A between the journal axis 34 and the bit axis 37A defines a first specific point of a line 36 used to determine an oversize angle 36A. The oversize angle 36A is subtended between the line 36 and the horizontal line 35 used to determine journal angle 37. The other specific point, shown at 33, for line 36 is at the intersection, or tangent, between the gage row cutting elements 30 and the gage curve 32. The gage curve depends on, among other factors, the bit diameter, journal angle, offset and locations of the gage row cutting elements. Calculation of the gage curve is known in the art.

In some embodiments of a bit made according to the invention, the oversize angle 35A is in a range of about −1.5 degrees (negative angle being defined as line 35 tilted in a direction downward away from the journal in the direction of the gage row 30) to +2 degrees.

Figure 4:
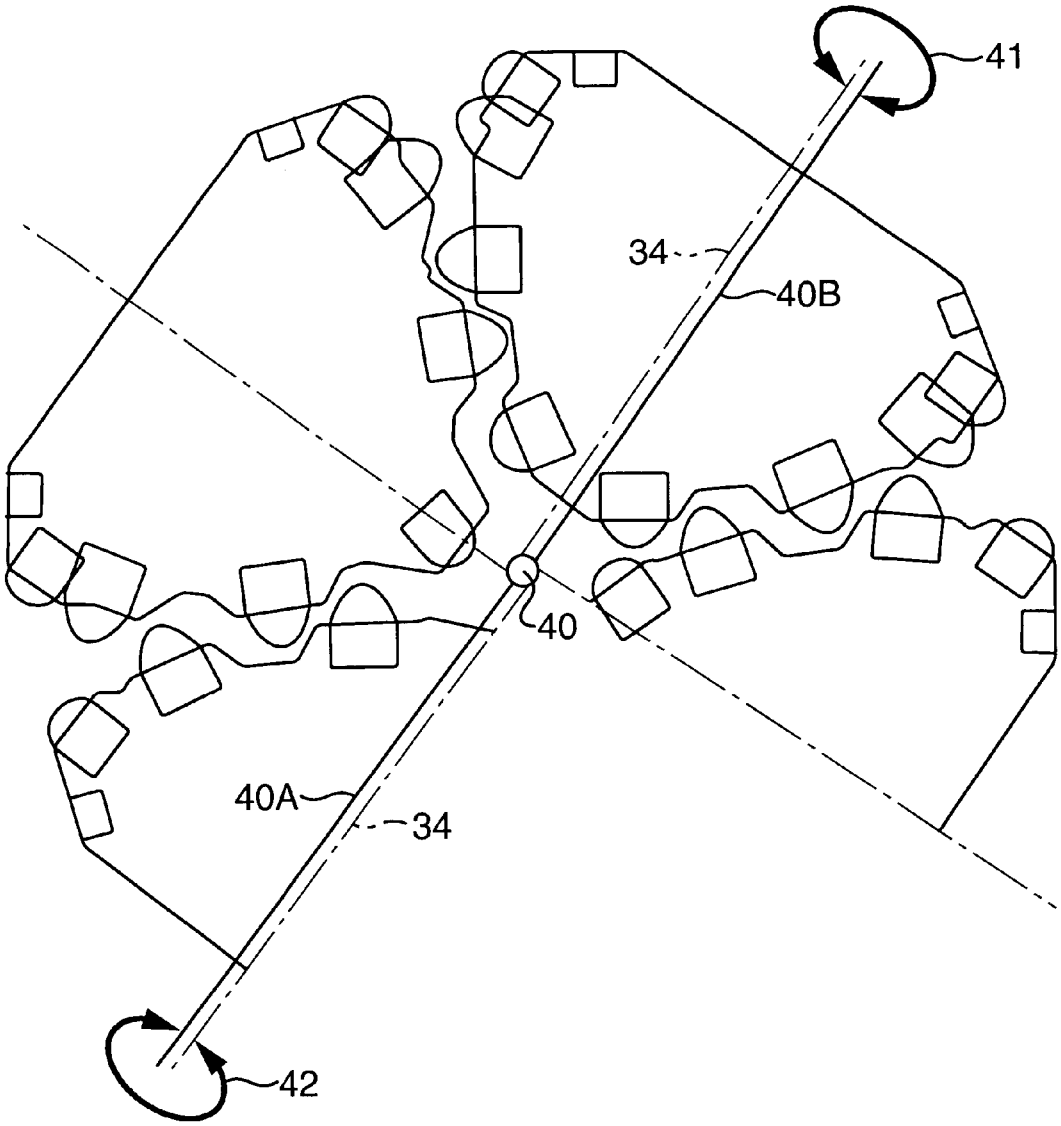
FIG. 4 shows a bottom view of an example of a roller cone bit to show offset.

FIG. 4 shows an example of a design parameter known as "bit offset". The rotational center of the bit is shown at 40. The center 40 corresponds to the axis of rotation (37A in FIG. 3) of the bit. A line 40A, 40B drawn perpendicular to the center 40, outward from the center 40, (that is, extending radially outward from the center 40) for each cone defines one boundary for determining the offset. The other boundary is the axis 34 of each cone. Offset is defined as the distance between each of the lines 40A, 40B and the corresponding cone axis 34. These distances are shown at 41 and 42 in FIG. 4. In the invention, the offset is less than about 0.15 inches (3.8 mm), and more preferably is less than about 0.125 inches (3.2 mm).

Drilling performance of drill bits having the journal angle, offset and oversize angle according to the various embodiments of the invention were simulated using a method described in U.S. patent application Ser. No. 09/524,088, filed on Mar. 20, 2000, and assigned to the assignee of the present invention. Bits made according to various embodiments of the invention were found to have improved rate of penetration during drilling and better dull bit condition than bits made according to the prior art. As described in the Background section herein, drill bit design principles are similar whether the roller cone bit is to be used with liquid or air drilling fluids. Accordingly, the invention is not to be limited to be used with any particular type of drilling fluid.

While the invention has been described with respect to a limited number of embodiments, those skilled in the art will appreciate that other embodiments can be devised which do not depart from the scope of the invention has disclosed herein. Accordingly, the scope of the invention should be limited only by the attached claims.

What is claimed is:

1. A roller cone drill bit, comprising:

at least one roller cone rotatably mounted on a journal forming a part of a bit body, the at least one cone having cutting elements disposed at selected locations thereon, wherein the cutting elements are arranged so that a gage row thereof defines an oversize angle within a range of about −1.5 to 2 degrees;

the at least one roller cone subtends a journal angle of less than about 35 degrees, and has an offset less than about 0.15 inches; and the bit has an International Association of Drilling Contractors classification of at least 6-1.

2. The roller cone drill bit as defined in claim 1 wherein the cutting elements comprise tungsten carbide inserts.

3. The roller cone drill bit as defined in claim 1 wherein the offset is less than about 0.125 inches.

4. A roller cone drill bit, comprising:

at least one roller cone rotatably mounted on a journal forming a part of a bit body, the at least one cone having cutting elements disposed at selected locations thereon, wherein the at least one roller cone subtends a journal angle of about 32.5 degrees, has an offset less than about 0.15 inches, and the cutting elements are arranged so that a gage row thereof defines an oversize angle within a range of about −1.5 to 2 degrees, wherein the bit has an International Association of Drilling Contractors classification of at least 6-1.

5. The roller cone drill bit as defined in claim 4 wherein the cutting elements comprise tungsten carbide inserts.

6. The roller cone drill bit as defined in claim 4 wherein the offset is less than about 0.125 inches.

* * * * *